US007942718B2

(12) United States Patent
Tenorio

(10) Patent No.: US 7,942,718 B2
(45) Date of Patent: May 17, 2011

(54) DIDACTIC GAME PIECE

(75) Inventor: Jose Maxenchs Tenorio, Barcelona (ES)

(73) Assignee: Educocio S.B., Barcelona (ES)

( * ) Notice: Subject to any disclaimer, the term of this patent is extended or adjusted under 35 U.S.C. 154(b) by 23 days.

(21) Appl. No.: 12/440,887

(22) PCT Filed: Sep. 20, 2007

(86) PCT No.: PCT/ES2007/000532

§ 371 (c)(1),
(2), (4) Date: Mar. 11, 2009

(87) PCT Pub. No.: WO2008/059076

PCT Pub. Date: May 22, 2008

(65) Prior Publication Data

US 2010/0056014 A1 Mar. 4, 2010

(30) Foreign Application Priority Data

Feb. 2, 2007 (ES) ..... 200700286

(51) Int. Cl.
*A63H 33/04* (2006.01)

(52) U.S. Cl. ..... 446/92; 446/129

(58) Field of Classification Search ..... 446/71, 446/72, 92, 129, 131, 133, 134, 135, 137–139; 273/155, 156, 157 R, 456; 434/211–215, 434/190, 208, 277–279, 301

See application file for complete search history.

(56) References Cited

U.S. PATENT DOCUMENTS

| | | | | |
|---|---|---|---|---|
| 2,939,243 | A | 6/1960 | Duggar | |
| 3,655,201 | A | 4/1972 | Nichols | |
| 5,127,652 | A * | 7/1992 | Unger | 273/157 R |
| 5,152,711 | A * | 10/1992 | Gross | 446/139 |
| 6,241,249 | B1 | 6/2001 | Wang | |
| 7,413,493 | B2 * | 8/2008 | Toht et al. | 446/92 |
| 7,758,395 | B2 * | 7/2010 | Kim et al. | 445/24 |
| 2004/0116038 | A1 * | 6/2004 | Hunts | 446/92 |
| 2006/0240737 | A1 * | 10/2006 | Yoon | 446/92 |

FOREIGN PATENT DOCUMENTS

| | | |
|---|---|---|
| BE | 888110 | 7/1981 |
| EP | 0051576 | 5/1982 |
| ES | 263451 | 7/1983 |
| ES | 2133234 | 9/1999 |
| FR | 2517979 | 6/1983 |
| WO | 2005118093 | 12/2005 |

* cited by examiner

*Primary Examiner* — Nini Legesse
(74) *Attorney, Agent, or Firm* — Sturm & Fix LLP

(57) ABSTRACT

An educational game having a number of parts where each part has a contact surface with first and second magnets movably joined to and interior face of the contact surface. A rod that defines a longitudinal axis parallel to the contact surface has the first magnet at one end and a second magnet at the opposite end, with the magnets having their polarity reversed to each other. An elongated housing encloses the rod on the interior face of the contact surface, and it moves the rod on the longitudinal axis along the housing.

5 Claims, 7 Drawing Sheets

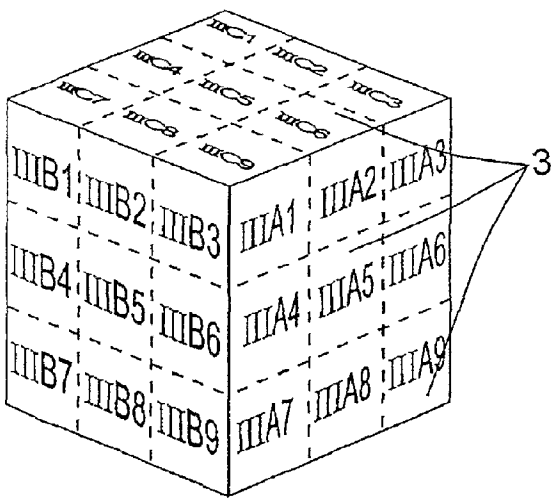
FIG. 9a
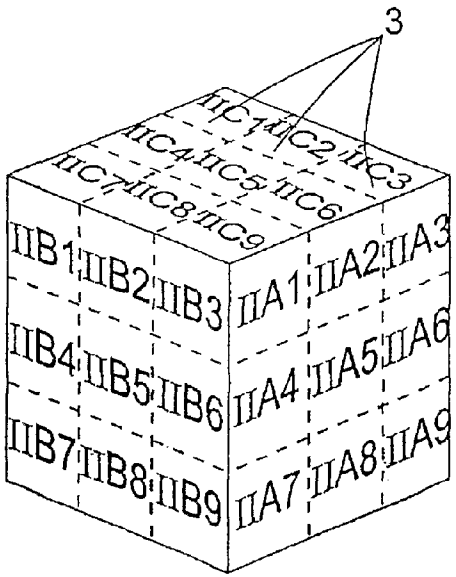
FIG. 9b
FIG. 9c

DIDACTIC GAME PIECE

FIELD OF THE INVENTION

The invention refers to an educational game part that has a contact surface and has at least a first magnet on the inner with its magnetic axis facing towards the contact surface.

STATE OF THE ART

Educational games are well known that are made up of a plurality of parts from which the user can make up complex assemblies. These complex assemblies can be of very different types: They can be simple geometric shapes so as to make constructions by means of the simple superimposing of the parts, they can be assembled or clickable parts that once assembled have a certain resistance to dismantling, they can be puzzles, cube puzzles, etc.

In certain cases it is interesting that the parts, once assembled, have a certain resistance to dismantling. As has been said previously parts of this type are known which have some means of connection on their surface. However, these reversible connection devices (such as some tight fitting dovetails) have a clear effect on the appearance of the part. In other cases the inclusion of magnets is used, both on the visible surface of the part and equally on the inner of same. However, the magnets have the disadvantage of generating a magnetic field with a specific orientation. In order to get a magnet to attract another magnet it is necessary for both magnets to be correctly orientated. When the opposite occurs a force of repulsion is generated instead of an attraction force. It is possible to include ferromagnetic elements, that are always attracted by a magnet, whatever the direction is, but this generates a 'selectivity' between the differing parts of the educational game. A specific part, that has a magnet on the inner, will only be able to be assembled with those parts that have a ferromagnetic element or with those parts that have a magnet orientated in the opposite direction, but it will not be able to be assembled with other parts; it will especially not be able to be assembled with another part that is identical to it.

SUMMARY OF THE INVENTION

The object of the invention is to overcome these disadvantages. This object is achieved by means of a part of an educational game of the type stated at the beginning, characterised in that the first magnet is joined to the part by means of some fixing means that have movement means that are suitable to move the magnetic axis of the first magnet in regard to the contact surface, in such a way that any contact surface of any part can face any contact surface of any other part, leaving both contact surfaces joined to each other by the forces of attraction of the respective magnets.

Thus, in order to be able to guarantee that any contact surface of the part can be joined to any contact surface of the other part it must be possible to orientate the magnets that face each other towards these surfaces in such a way that they have the right polarity so as to exercise an attraction force from one to the other. In order to do this it is necessary for the magnets to be able to be moved. Preferably this orientation must be made in an automatic manner, this means, without the need for the user to carry out any specific action. In this sense, the means of movement are activated by the attraction force and repulsion itself between the magnets. If two faces of two contact surfaces of two parts are facing each other in which the respective magnets have the same orientation of the magnetic poles, a repulsion force will be generated that will tend to separate them. The means for the movement will be activated by the repulsion forces in such a way that the two magnets change their relative position in the space. This will allow the magnets to move to a new relative position in which an attraction force is exercised between both parts.

There are differing forms of designing the movement means that fulfil with these conditions. Next, a description of some of them is given by means of the figures, without this excluding the possibility of there being others.

Likewise the object of the invention is an educational game made up from a plurality of parts, characterised in that at least two of said parts are according to the invention.

Likewise the object of the invention is a puzzle made up from a plurality of cubes, wherein each face of each cube shows a fragment of the image, characterised in that each cube is a part according this invention.

Preferably the puzzle is made up of a quantity of cubes whose cube root is a whole number and the cubes are suitable for arranging three-dimensionally forming a bigger cube in such a way that each one of the faces of the bigger cube shows an image made up by the images fragments of each one of the visible faces of each one of the cubes. Thus, the bigger cube will have dimensions (height, width and depth) made up from a specific number of cubes. Each dimension will have the same number of cubes. Therefore, the bigger cube will have a quantity of cubes that will be a whole number raised to the cube ($2^3$, $3^3$, $4^3$, etc.). Therefore, the total amount of cubes of the puzzle will be a number whose cubic root is a whole number (8, 27, 64, etc.), in this way a new type of puzzle cube is achieved, with special and attractive complexity. Preferably, the puzzle will have 8, 27 or 64 cubes and the most preferable will be with 27 cubes, as these are the most suitable quantities to make a puzzle with an achievable difficulty.

The bigger cube can be made in many different shapes. For example, if the bigger cube is made up of 27 cubes, the bigger cube can show 18 different images, in such a way that, once completely constructed, the bigger cube shows 6 simultaneous complete images, one of each of the faces of the bigger cube. If the bigger cube is made up of 64 cubes, the bigger cube can show 24 different images. In this way this puzzle has some difficulty and a greater attraction than the conventional puzzle cubes.

BRIEF DESCRIPTION OF THE DRAWINGS

Other advantages and characteristics of the invention can be appreciated from the followings description, in which, without being in any way a limitation, some preferred ways of embodying the invention are described, making mention of the drawings which are attached. The figures show:

FIGS. 9*a*, 9*b* and 9*c* with some views in perspective of a puzzle according to the invention

DETAILED DESCRIPTION OF SOME FORMS OF EMBODYING THE INVENTION

Figure 1:
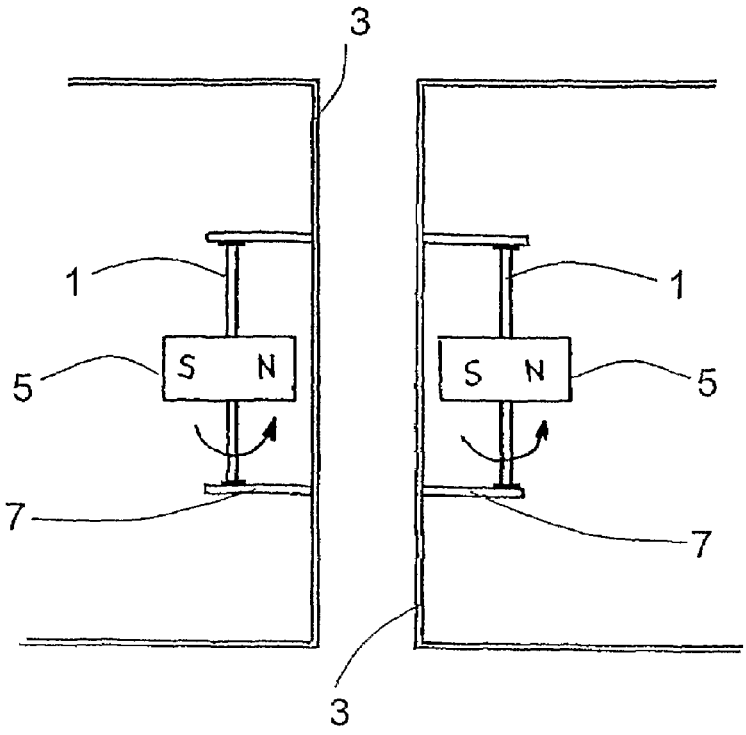
FIGS. 1, 2, 3 and 4, some diagrammatic views of some longitudinal sections of some parts for an educational game with four preferred forms of embodying the movement means according to the invention.

FIG. 1 shows a diagrammatic view of a longitudinal section of an educational game part with first way of an embodiment of movement means, characterised in that it has a rotation axis 1 parallel to contact surface 3 and the first magnet 5 is connected to the rotation axis 1. In this case the movement is a simple turning round of the first magnet 5 turning perpendicular on its magnetic axis. The first magnet 5 is joined to the part by means of some fixing means 7.

Figure 2:
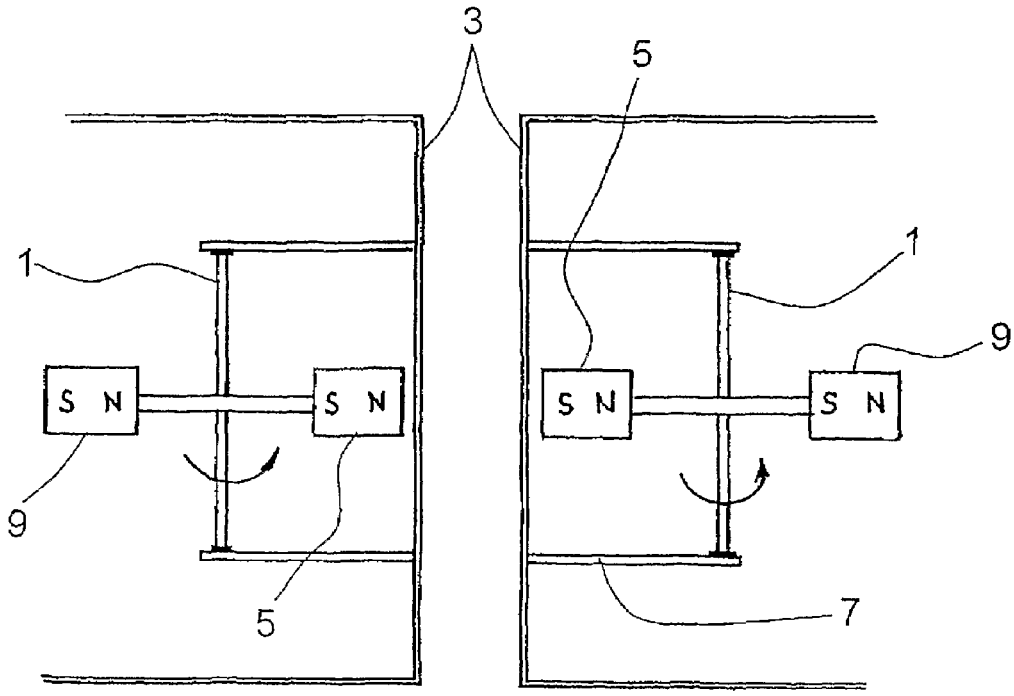

FIG. 2 shows a second form of an embodiment with some means of movement, which is a variation of the embodiment in FIG. 1 and is characterised in that it has a second magnet 9 connected to the rotation axis 1 parallel to contact surface 3, wherein the second magnet 9 has its polarity reversed compared to the first magnet 5 and is angularly moved, in the direction of the rotation axis 1, compared to the first magnet 5. Specifically, in the example of FIG. 2 the first magnet 5 and the second magnet 9 are arranged at a 180° angle to the rotation axis 1, this means diametrically opposed to the rotation axis 1. The workings are identical to the movement means in FIG. 1, with the difference being that instead of having a single magnet more or less elongated there can be two shorter magnets, but maintaining a pair of raised forces compared to the rotation axis 1. When two cubes come towards each other, if the magnets do not have a suitable polarity, a force of repulsion is generated between them which makes them turn on their rotation axis 1 parallel to contact surface 3 until two magnets are facing each other with a suitable polarity. The other magnet stays on the inner of the cube; sufficiently far away from any other magnet in such a way that it does not exercise or suffer from any significantly increased force.

Figure 3:
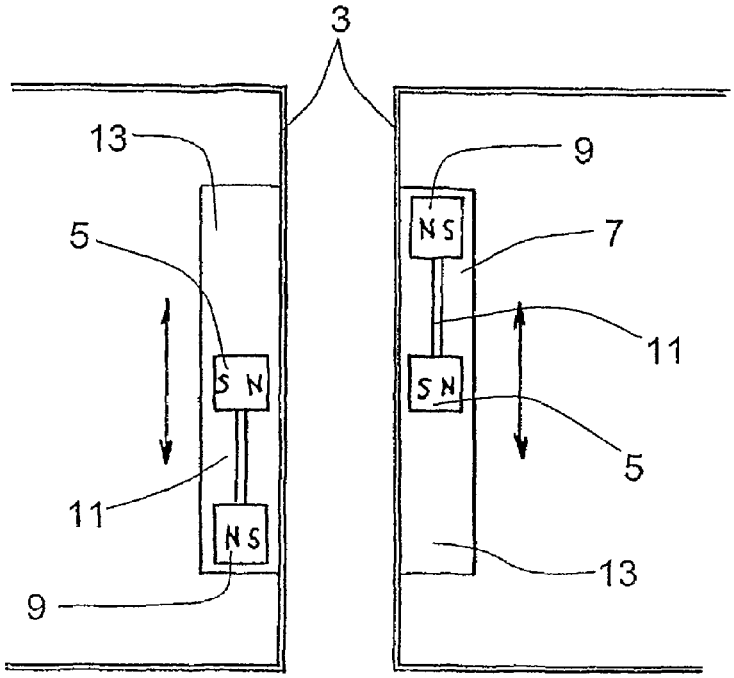

FIG. 3 shows another example of an embodiment of the movement means. This case is characterised in that there are: [a] a rod 11, that makes a longitudinal axis parallel to the contact surface 3, with the first magnet 5 fitted at one of its ends and a second magnet 9 fitted at the opposite end, wherein the first and the second magnets 5 and 9 have their polarity reversed one to the other, and [b] a housing 13 elongated along the longitudinal axis, wherein the housing 13 is of such a size so that it can be housed on the inner of the rod 11 and is suitable so that it will allow the rod 11 to move on the longitudinal axis along the length of the housing 13. In this case, if the two magnets face each other and do not have the right polarity, a repulsion force is generated that forces them to move along the housing 13. In the solution shown in FIG. 3, it will therefore be able to have two different situations. If the two parts that come towards each other are exactly as shown in the FIG. 3, the attraction will be exercised between the two magnets that are in the middle of the respective contact surfaces 3, whilst the magnets that are at both ends will not provide any force for the joining between the two cubes. If, however, one of the parts is turned in the reverse direction as shown in FIG. 3 (this means, with the magnet that is at the upper end of housing 13, according to the figure, put in the bottom end), then it will be able to exercise an attraction force between the four magnets, two to two. In this case the attraction force will have to be greater or lesser in line with the relative position of both parts. It must be highlighted that the housings 13 do not have to be parallel, as they could also be perpendicular to each other.

Figure 4:
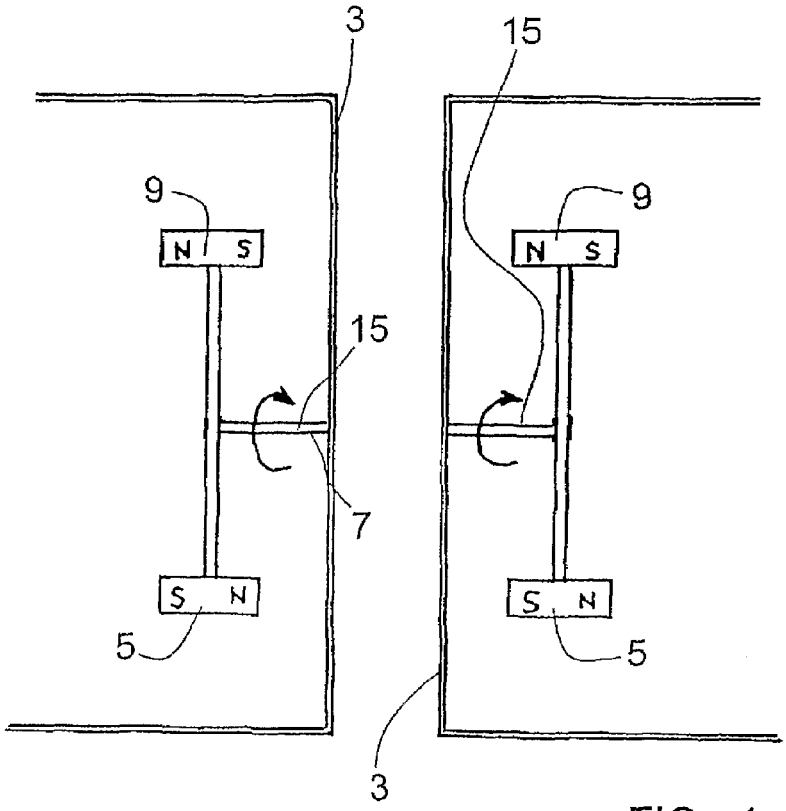

Finally, in FIG. 4 another form of embodiment is shown of the movement means. In this case the movement means has a rotation axis 15 perpendicular to contact surface 3 and include a first magnet 5 and a second magnet 9 that have their magnetic axes parallel to each other and one has the polarity reversed to the other, wherein both magnets 5 and 9 are angularly moved against each other in the direction of the rotation axis 15 perpendicular to contact surface 3, and wherein the magnets 5 and 9 are moved by means of a turn on the axis 15 perpendicular to contact surface 3. The two magnets 5 and 9 could be arranged in an asymmetrical manner compared to the rotation axis 15, perpendicular to contact surface 3. They could be in a manner that is not diametrically opposed; they could be angularly moved through 180° but at a different distance from the rotation axis 15 perpendicular to contact surface 3, etc. However, by preference the rotation axis 15 perpendicular to contact surface 3 is at a mid-point between both magnetic axes.

In the examples shown in FIGS. 2 and 4 other solutions are possible with more magnets, for example with 4 magnets distributed in a cross around the rotation axis 1 or 15 respectively.

Figure 5:
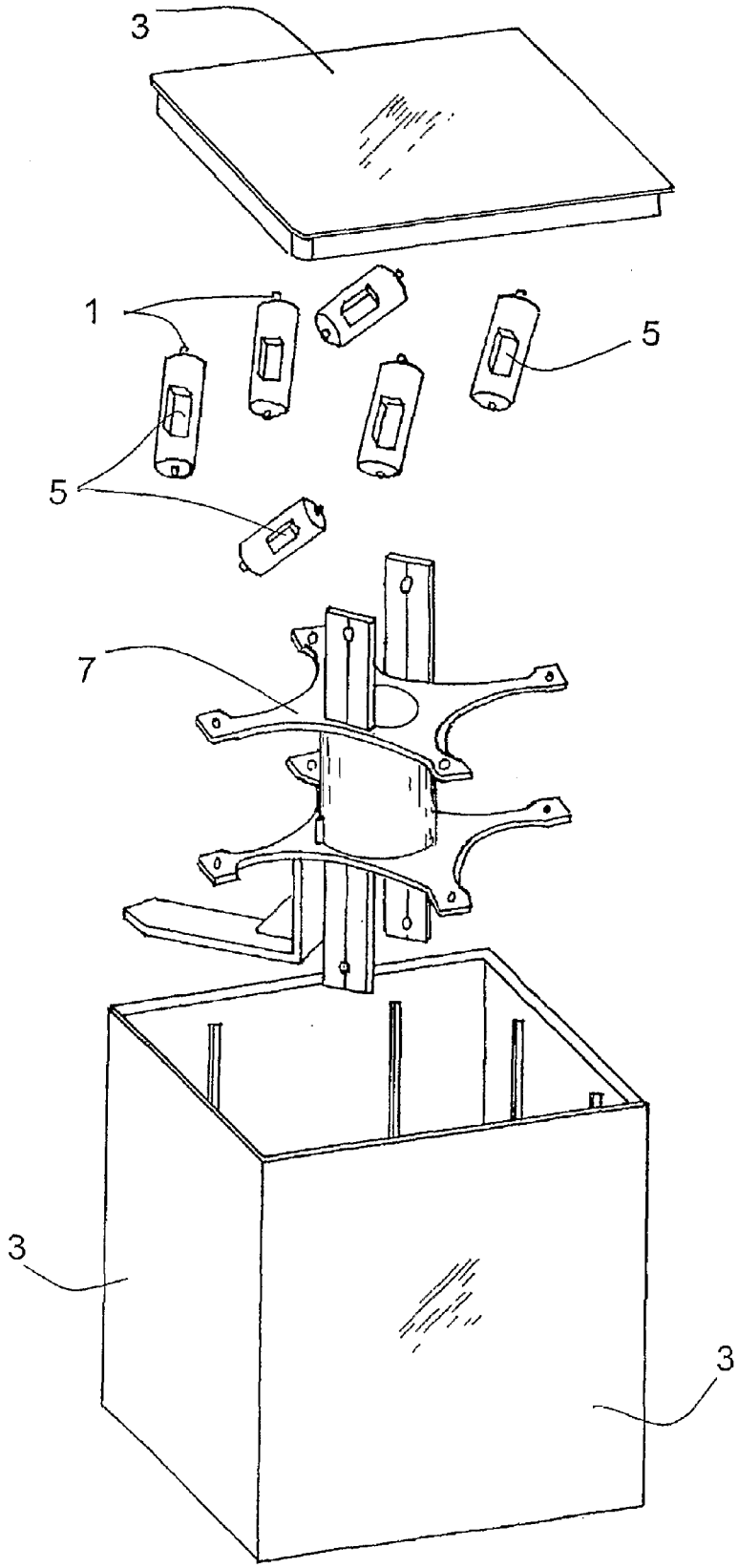
FIG. 5, some exploded perspective views of a cube with a preferred structure for the specific embodiment of some fixing means with those in FIG. 1.
Figure 6:
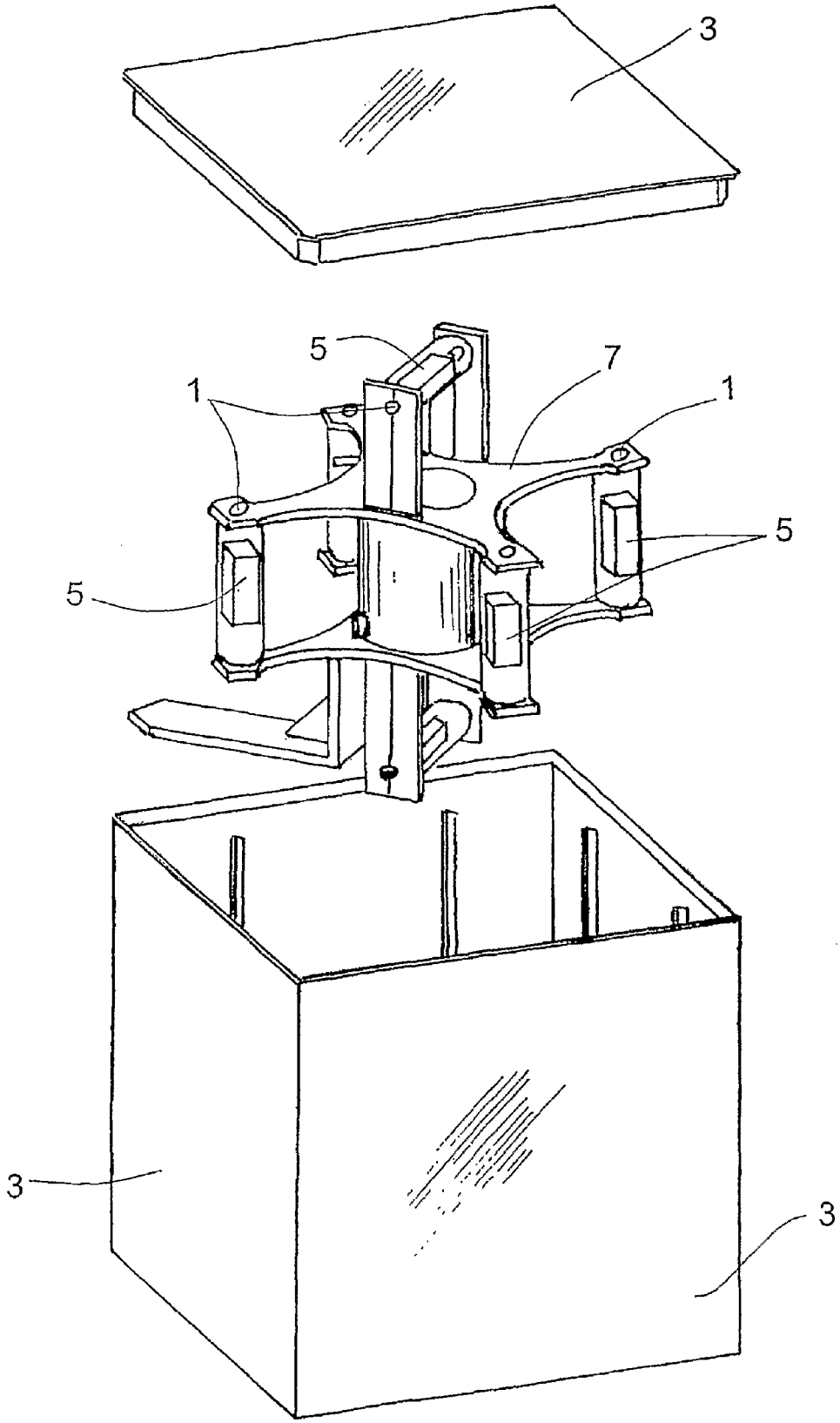
FIG. 6, the view of FIG. 5 with the fixing means pre-assembled.
Figure 7:
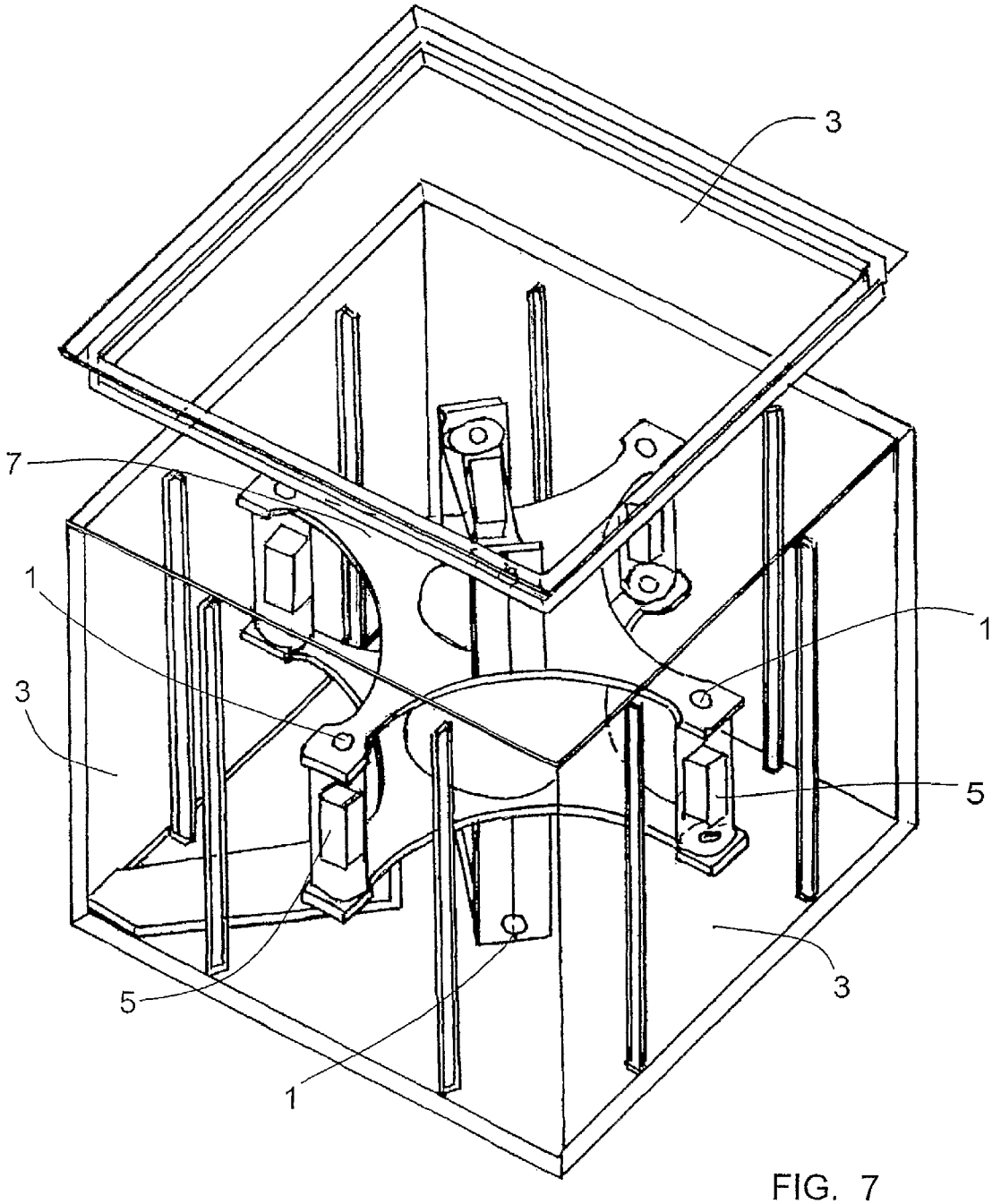
FIG. 7, the view of FIG. 6, with the fixing means housed on the inner of the cube.

In FIGS. 5 to 7 detailed a practical embodiment is shown of a cube with some movement means as shown diagrammatically in FIG. 2. The cube has a magnet (a first magnet 5, in accordance with the nomenclature used) on each one of the faces 3. Therefore, the cube can connect with any other cube with any of its faces. In particular it can make the bigger cube of the puzzle which is the object of this invention with the peculiarity that it allows any order of assembly, this means, it can be assembled both if the relative position between the cubes is the correct one to form any image or equally if it is wrong. Therefore, the reversible means of connection are independent from the game in itself (to position the cubes in the order that is appropriate to obtain the images) and do not give any type of clue or guidance as to which is the correct order for the assembly of the cubes. The reversible means of connection are limited to maintaining the cubes connected to each other as and how positioned by the user.

Figure 8:
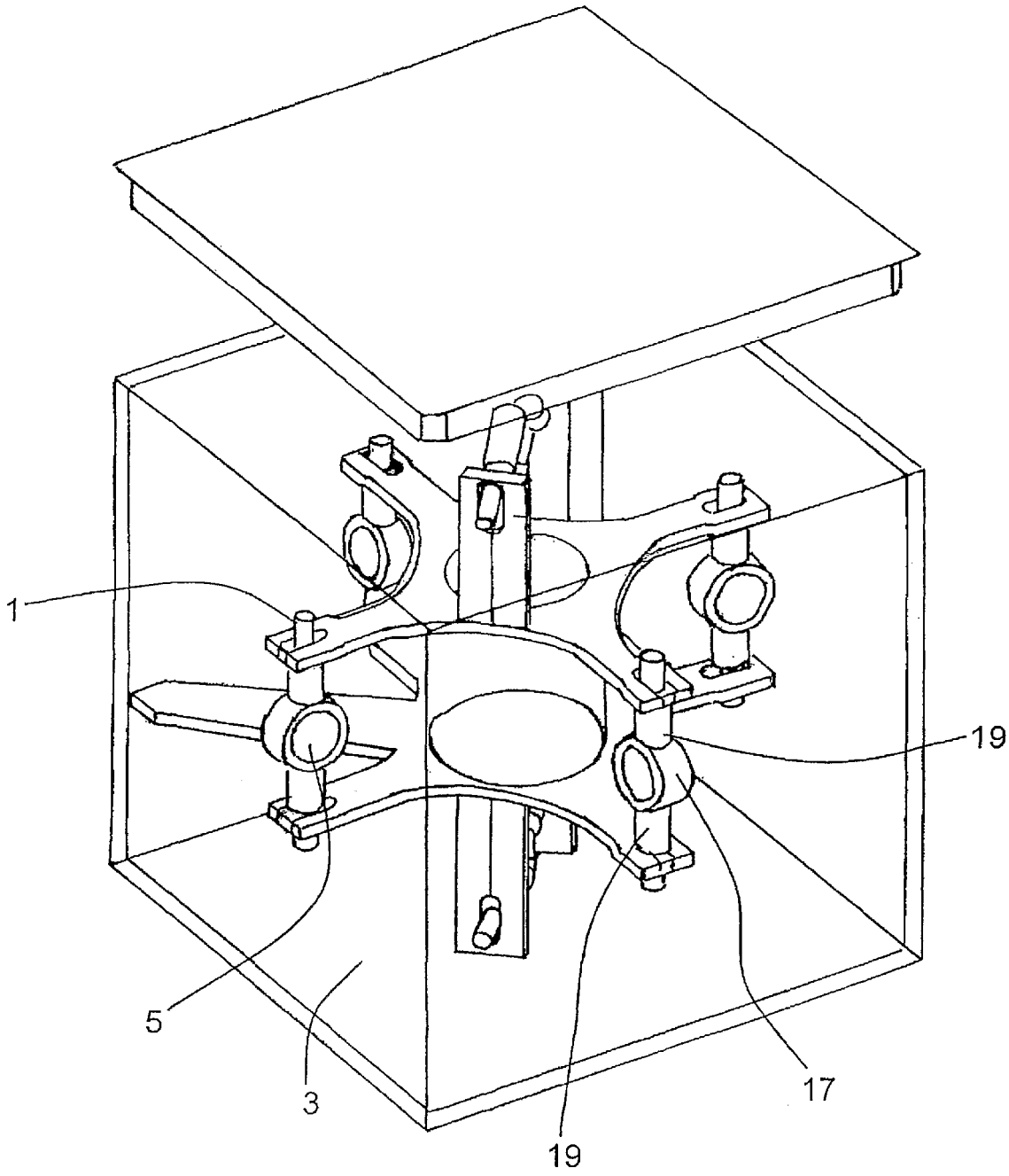
FIG. 8, a perspective view of a cube with another preferred structure for the embodiment of some fixing means like those in FIG. 1.

In FIG. 8, a variation of the movement means is shown that includes a cylindrical bushing 17 that forms a cylindrical housing inside of which magnet 5 is housed (the first magnet 5, in accordance with the nomenclature used). Two rods 19 are projected from the cylindrical bushing 17 that are radially and opposing each other, that have a first section joined to the bushing 17, with a greater diameter and a second section, at the free end, with a smaller diameter, in such a way that both ends are adapted so as to allow them to be housed in some openings made in the movement means, wherein these openings define the rotation axis 1 parallel to face 3.

In all the previous examples it has been shown that the contact surface 3 is a flat surface. This will be the normal case, as the parts will frequently be geometrically simple, such as cubes, parallelepiped, prisms, pyramids, etc. However, it is not necessary for it to be like this. The contact surfaces 3 can be curves as the only thing required is that a specific pair of parts has a specific contact surface on one of the parts and the "negative" of the contact surface on the other part. Along these lines the surfaces can be hemispherical, cylindrical, etc., and even geometrically complex. Neither is it necessary for all the surfaces of a specific part to be contact surfaces in the sense that they have a magnet (or some magnets) associated to it. It is perfectly possible that on a specific part contact surfaces (with magnets associated to them) coexist with other surfaces that are not contact surfaces, in the sense that that do or do not have magnets associated to them.

FIGS. 9*a*, 9*b* and 9*c* show a specific shape of the embodiment of a puzzle according to the invention. The puzzle is made up of 27 cubes that can be grouped together making up a bigger cube of 3×3×3 cubes. Each face 3 of each one of the cubes has been identified by means of a three digit number and letter code, XYZ. The X corresponds to the alternative of the bigger assembled cubes: Three bigger cubes can be assembled that are identified as I, II and III. The Y corresponds with the face of the bigger cube, the bigger cube has six faces identified as A, B, C, D, E and F. The Z corresponds with the position of the face of the cube compared to the face of the bigger cube, each face of the bigger cube is made up of nine faces of nine cubes, identified as 1, 2, 3, 4, 5, 6, 7, 8 and 9.

The invention claimed is:

1. Apparatus comprising an educational game having a plurality of parts, each of the plurality of parts including a contact surface having a visible face and an interior face, and that has a first magnet on the interior face with its magnetic axis facing towards said contact surface, said first magnet being joined to said part by fixing means that has movement means that are suitable for moving said magnetic axis with respect to said contact surface, in such a way that any contact surface of any of the plurality of parts faces up toward any contact surface of any other of the plurality of parts, both parts being joined to each other by the attraction forces of magnets;

said movement means having a rod that defines a longitudinal axis parallel to said contact surface, with the first magnet fitted at one end of the rod and a second magnet fitted at an opposite end of the rod, said first and second magnets having their polarity reversed to the other, and a housing elongated along said longitudinal axis, said housing being of such a size that it is suitable to house said rod on the interior face of the contact surface and it is suitable to move said rod on said longitudinal axis along said housing.

2. The apparatus of claim 1, further comprising said movement means having a rotation axis parallel to said contact surface and said first magnet is joined to said rotation axis parallel to said contact surface.

3. The apparatus of claim 2, further comprising a second magnet connected to said rotation axis parallel to said contact surface, said second magnet having its polarity reversed to the said first magnet, and is angularly moved, in the direction of said rotation axis parallel to said contact surface, with respect to said first magnet.

4. The apparatus of claim 1, further comprising said movement means having a rotation axis that is perpendicular to said contact surface and comprises said first magnet and a second magnet, said first and second magnets having magnetic axes which are parallel to each other and each one having the polarities reversed to the other, said first and second magnets being angularly moved from one to the other in the direction of said rotation axis perpendicular to said contact surface, and said magnets being moved by a rotation on said rotation axis perpendicular to said contact surface.

5. The apparatus of claim 4, further comprising said rotation axis perpendicular to said contact surface being at a mid point between said magnetic axes.

* * * * *